United States Patent [19]

Sneider

[11] 4,154,323

[45] May 15, 1979

[54] MULTI-PURPOSE BAG

[76] Inventor: Jill A. Sneider, 101 Erfield Pl., Syracuse, N.Y. 13214

[21] Appl. No.: 925,097

[22] Filed: Jul. 17, 1978

[51] Int. Cl.[2] ..... A45C 9/00

[52] U.S. Cl. ..... 190/2; 5/417; 150/1

[58] Field of Search ..... 190/1, 2, 42; 150/1, 150/28 R, 35, 1.7; 50/344

[56] References Cited

U.S. PATENT DOCUMENTS

| | | | |
|---|---|---|---|
| 1,222,563 | 4/1917 | Rosenberg | 5/344 |
| 2,543,597 | 2/1951 | Peery | 190/42 X |
| 3,489,194 | 1/1970 | Hoover | 190/1 X |
| 3,579,675 | 2/1970 | Scheer | 5/344 X |
| 4,068,786 | 1/1978 | Taniguchi | 5/344 X |

*Primary Examiner*—Donald F. Norton

*Attorney, Agent, or Firm*—Charles S. McGuire

[57] ABSTRACT

A carrying bag primarily intended for holding diapers and other baby supplies and incorporating a flexible strip of material detachably secured to an inner portion of the bag. The flexible strip may be rolled up and secured inside the bag or unrolled, being of appropriate dimensions and material to provide a sanitary and convenient surface upon which a baby may be placed for changing diapers.

9 Claims, 6 Drawing Figures

MULTI-PURPOSE BAG

BACKGROUND OF THE INVENTION

The present invention relates to carrying bags and, more specifically, to a multi-purpose baby accessory bag.

Diaper bags and similar hand-carried baby accessory bags are available in a wide variety of designs and constructions. It is often inconvenient, however, as when traveling, to locate a sanitary surface to place the baby upon while changing diapers. It is a principal object of the present invention to provide a multi-purpose bag suitable for carrying diapers and other baby accessories and incorporating a sanitary and readily available surface for holding the baby while changing diapers.

Other objects will in part be obvious and will in part appear hereinafter.

SUMMARY OF THE INVENTION

The carrying bag of the present invention includes the usual side and bottom walls and may be open at the top, as disclosed, or include a top closure member. Straps are attached to each side in the usual manner for hand or shoulder carrying. Pockets, pouches, and the like, may be provided both externally and internally of the bag itself. In the disclosed embodiment, for example, patch pockets are stitched on both sides of the exterior of the bag and an additional pouch or inner bag of plastic or other waterproof material is detachably secured on the inside of the main bag to hold soiled diapers.

A rectangular strip of flexible material, preferably a plastic-lined fabric, is secured either permanently or detachably along one edge thereof to the inner surface of the bag near the top. This strip may be rolled up and held within the upper part of the bag, secured by a tie-string, or the like. When the strip is unrolled to extend outwardly from the bag, it may be placed upon any convenient support to provide a sanitary surface upon which the baby may be placed while changing diapers.

DETAILED DESCRIPTION

Figure 1:
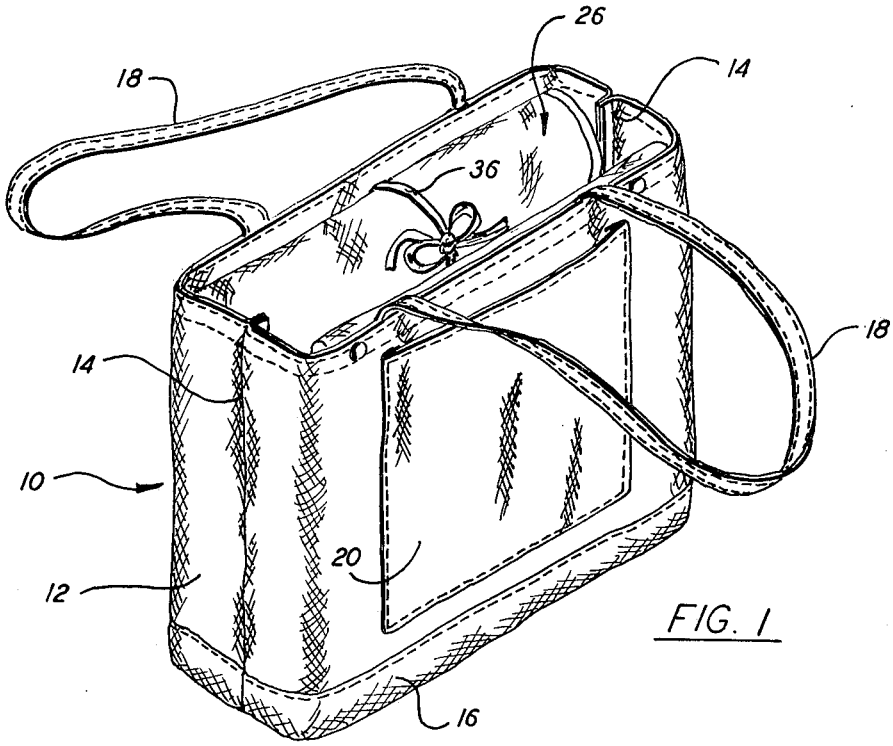
FIG. 1 is a perspective view of the bag with the flexible strip rolled up.
Figure 2:
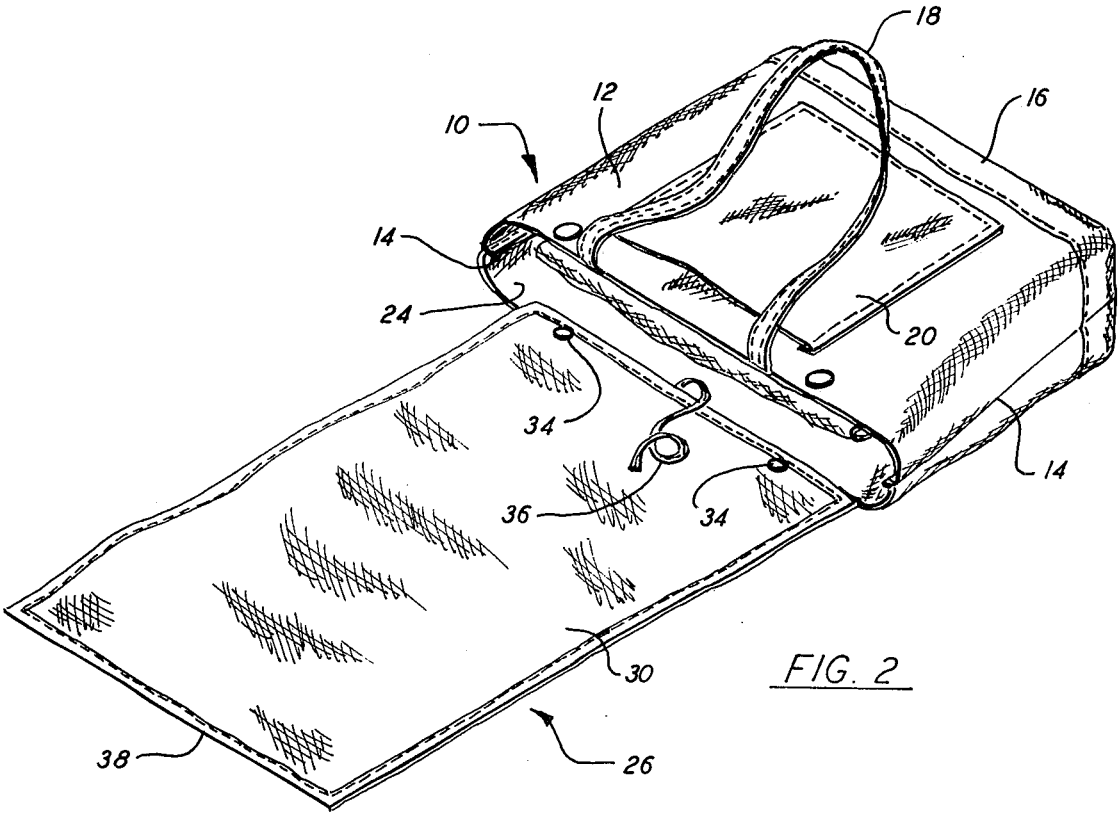
FIG. 2 is a perspective view of the bag with the strip unrolled.
Figure 3:
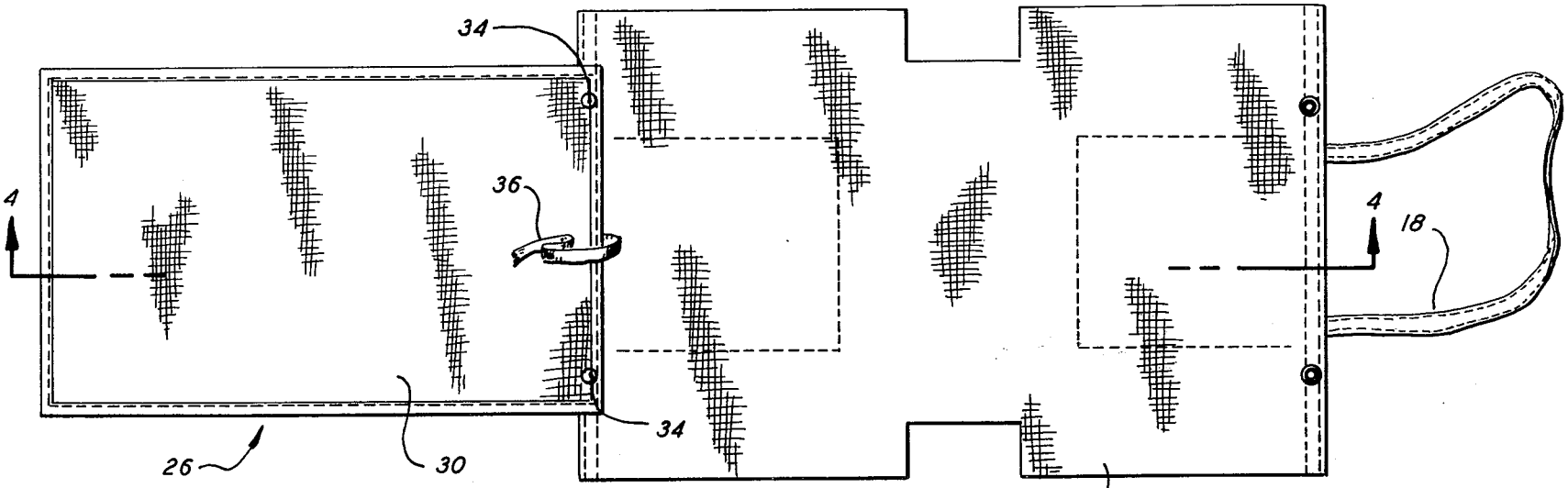
FIG. 3 is a plan view of the bag prior to forming the side seams showing the interior surface.

Referring now to the drawings, the carrying bag of the invention is generally denoted in FIGS. 1 and 2 by reference numeral 10 and includes a main bag or body portion 12 formed from a suitably shaped blank of material such as denim fabric, or any other material commonly employed for such purpose, stitched along the edges to form side seams 14. A separate sheet of material 16 is stitched around the lower end of bag 10 to form a reinforced bottom wall. Loops or straps 18 are affixed at each end to opposite sides of bag 10 at the upper edges of body portion 12. Patch pockets 20 and 22 are stitched to body portion 12 on opposite exterior surfaces of the bag. Bag 10 is preferably fully lined with sheet 24 of plastic or other such moisture-impervious material which is flexible yet strong enough to resist tearing or puncture.

Figure 4:
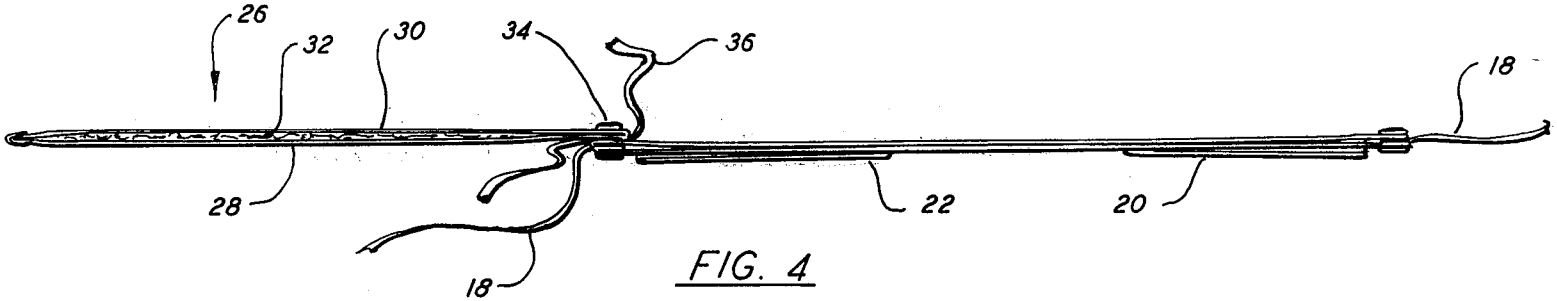
FIG. 4 is a side elevational view of the bag prior to forming the side seams.
Figure 5:
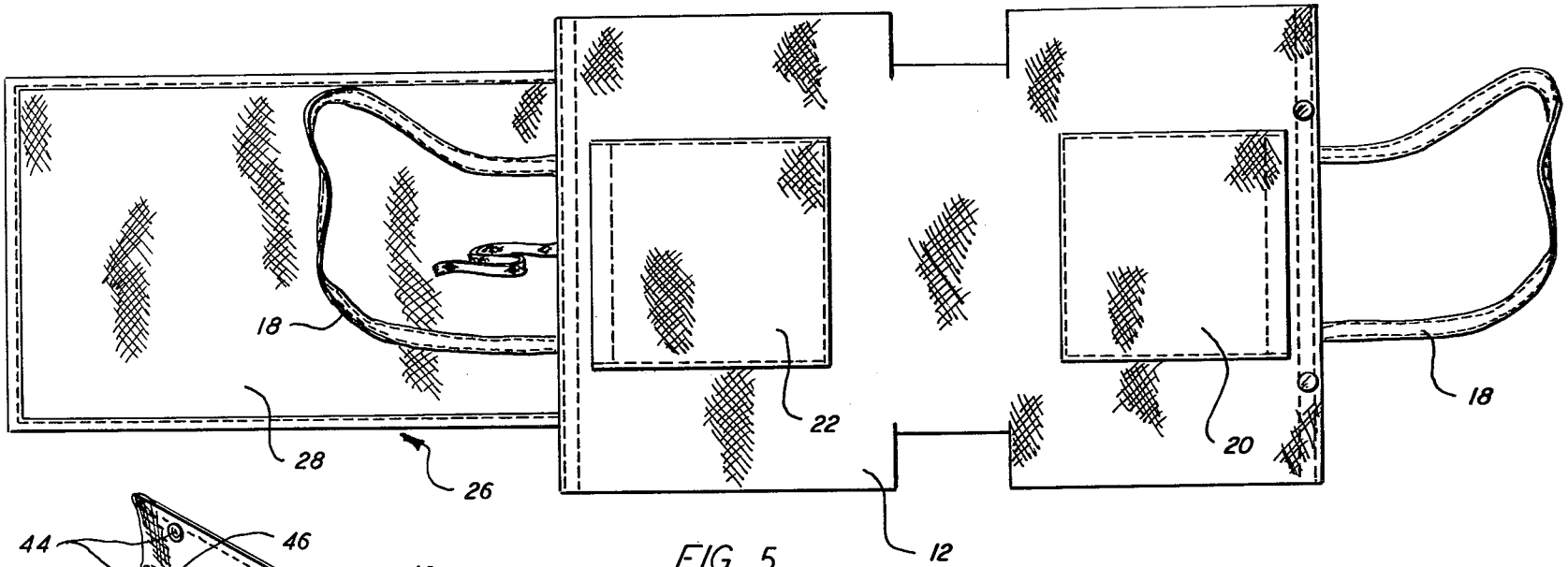
FIG. 5 is a plan view, as in FIG. 3, showing the external surface of the bag.

Rectangular strip 26 is likewise formed from superposed sheets of fabric material 28 and plastic 30, stitched together about their peripheries. As indicated in the sectional view (FIG. 4) a layer 32 of foam or other such resilient padding material is preferably provided between sheets 28 and 30. Strip 26 may be permanently secured along one edge to the upper interior of body portion 12 by stitching or bonding, but is preferably detachably secured by the indicated snaps 34, or by a zipper, Velcro, etc. Tie member 36 is affixed to body portion 12 adjacent the center of the edge at which strip 26 is attached so that opposite ends of member 36 lie on opposite sides of strip 26. In this manner, strip 26 may be rolled from edge 38 thereof (FIG. 2) toward the open end of body portion 12 and secured by tying member 36 thereabout as indicated in FIG. 1.

When strip 26 is rolled and tied as in FIG. 1, it lies within the upper portion of bag 10, leaving ample room for diapers and other baby accessories in the lower portion. The member 36 may be untied and strip 26 unrolled and laid upon a table or other suitable support, as indicated in FIG. 2, to provide a convenient and sanitary surface upon which to place a baby while changing diapers. Sheet 30, being of plastic material may be easily cleaned and strip 26 may be detached from bag 10 for separate washing.

Figure 6:
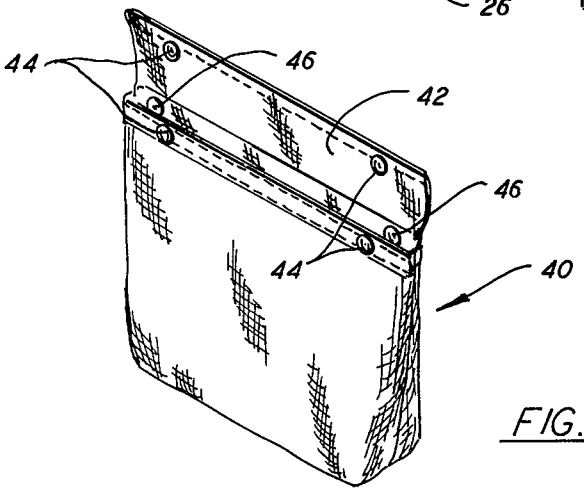
FIG. 6 is a perspective view of a detachable inner bag.

Also preferably detachably associated with bag 10 is inner bag 40, shown separately in FIG. 6. Inner bag 40 is formed entirely of a moisture-impervious material similar to or the same as that of sheets 24 and 30. Inner bag 40 includes an upper closure in the form of flap 42 which may be secured in the closed position by snaps 44. Snaps 46, or other appropriate fasteners, provide means for securing inner bag 40 within body portion 12, thereby forming a separate waterproof inner container to segregate soiled and clean diapers.

What is claimed is:

1. A baby accessory bag incorporating means providing a surface for supporting a baby while changing diapers, said bag comprising:

(a) a body portion having side and bottom walls forming a receptacle with internal and external surfaces in which diapers and other accessories may be carried;

(b) at least one carrying strap affixed to said body portion for supporting the latter in an upright position;

(c) an elongated strip of flexible material having an edge portion secured to an internal surface of said body portion and extensible therefrom to provide a planar surface of dimensions suitable for holding a baby when placed on a planar support; and (d) means for securing said strip in a compact position adjacent said edge portion thereof when not in use.

2. The invention according to claim 1 wherein said edge portion is secured to an internal surface of said side wall adjacent the end thereof opposite said bottom wall.

3. The invention according to claim 1 wherein said strip is rectangular and said edge portion comprises one of the short sides thereof.

4. The invention according to claim 3 wherein said strip is detachably secured to said body portion.

5. The invention according to claim 4 wherein at least one side of said strip is formed of waterproof material.

6. The invention according to claim 5 wherein said edge portion is secured to an internal surface of said side wall and said securing means comprises a member adapted to releasably hold said strip in a rolled-up condition.

7. The invention according to claim 6 wherein said bag is open at the top, formed by the upper periphery of said side wall, and said strip is held in said rolled-up condition within said body portion adjacent said upper periphery.

8. The invention according to claim 7 wherein said securing means comprises a flexible tie member affixed to said internal side wall surface adjacent said upper periphery thereof and adapted to encircle and be tied about said strip when the latter is in said rolled-up condition.

9. The invention according to claim 8 and further comprising a secondary enclosure of waterproof material, of dimensions suitable for containing soiled diapers, secured within said body portion.

* * * * *